United States Patent [19]

DeCecca et al.

[11] Patent Number: 5,008,538

[45] Date of Patent: Apr. 16, 1991

[54] CORONA CHARGER APPARATUS OF SIMPLIFIED CONSTRUCTION

[75] Inventors: Michael L. DeCecca, Fairport; Michael S. Kowalczyk, Rochester; Thomas W. Gray, Rochester; Paul W. Partridge, Rochester, all of N.Y.

[73] Assignee: Eastman Kodak Company, Rochester, N.Y.

[21] Appl. No.: 389,192

[22] Filed: Aug. 3, 1989

[51] Int. Cl.[5] ..... H01T 19/04

[52] U.S. Cl. ..... 250/324; 361/229; 361/230

[58] Field of Search ..... 250/324, 325, 326; 361/229, 230

[56] References Cited

U.S. PATENT DOCUMENTS

| | | | |
|---|---|---|---|
| 4,104,521 | 8/1978 | Herrmann et al. | 250/324 |
| 4,764,675 | 8/1988 | Levy | 250/324 |
| 4,803,512 | 2/1989 | Ogura et al. | 250/324 |

*Primary Examiner*—Bruce C. Anderson
*Attorney, Agent, or Firm*—Lawrence P. Kessler

[57] ABSTRACT

A universally adaptable corona charger apparatus of simplified construction which is replaceable by an unskilled operator and is inexpensive so that discarding the apparatus when it is no longer useful is cost justified. The corona charger apparatus comprises a conductive corona wire, a generally U-shaped conductive shield, a generally U-shaped non-conductive housing, and a pair of non-conductive end caps. The housing is formed with integral features which retain and accurately space the shield within the housing, locate and properly tension the corona wire, locate and support a grid if required, support electrical terminals for the corona wire and grid, retain and locate the end caps, and enable the assembled apparatus to be accurately located by an unskilled operator. By use of the integral features, the corona charger apparatus is substantially simpified with a concomitant reduction in its cost. Further, the corona charger apparatus has a universal nature in that it is adapted to be readily configured in a desired manner to carry out a particular desired electrostatographic process step.

9 Claims, 5 Drawing Sheets

FIG. 5
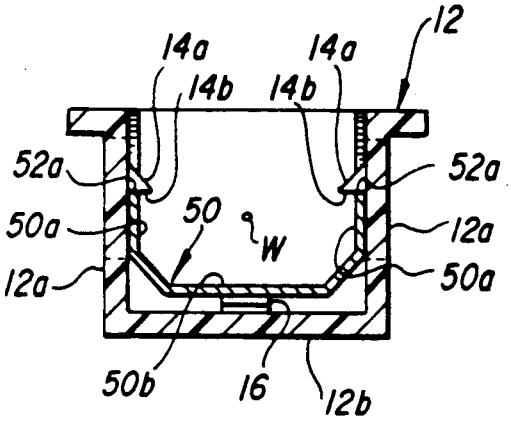
FIG. 6a
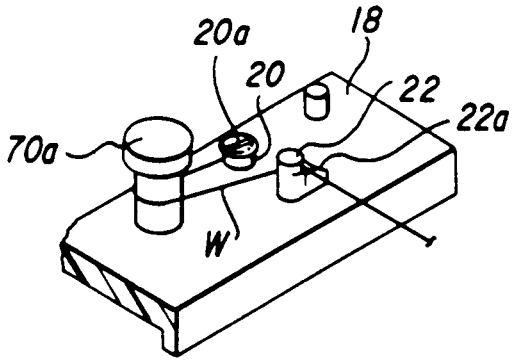
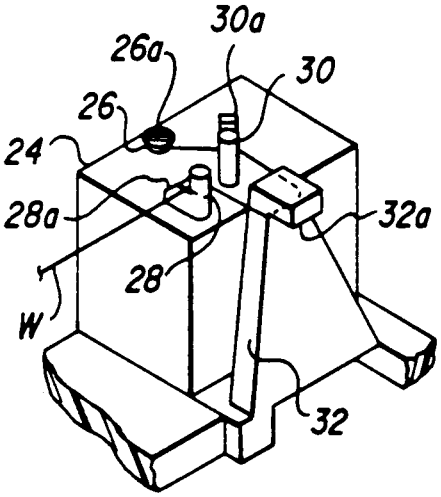
FIG. 6b
FIG. 7
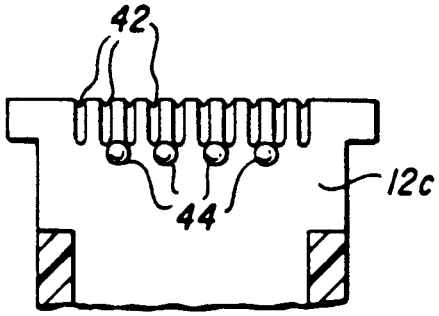

CORONA CHARGER APPARATUS OF SIMPLIFIED CONSTRUCTION

BACKGROUND OF THE INVENTION

This invention relates generally to corona charger apparatus for use in electrostatographic reproduction devices, and more particularly to corona charger apparatus of simplified universal construction which can be used to accomplish any of various electrostatographic process steps requiring charge deposition.

In electrostatographic reproduction devices (copiers or copier/duplicators), a latent image charge pattern is formed on a dielectric support by altering a uniform electrostatic charge on the support in image-wise fashion corresPonding to information to be reproduced. Alteration of the uniform charge is accomplished, for example, by exposing a dielectric support including a photoconductive layer to a light image of information to be reproduced. Alternatively, alteration of the uniform charge may be accomplished by other well known methods such as exposure to electronically generated light signals.

After the latent image charge pattern is formed pigmented marking particles are attracted to the latent image charge pattern formed on the dielectric support to develop such image on the support. The dielectric support is then brought into contact with a receiver member and an electric field applied to transfer the marking particle developed image to the receiver member from the dielectric support. After transfer, the receiver member bearing the transferred image is detached from the dielectric support and transported away from the support to a device where the image is fixed to the receiver member by heat and/or pressure to form a permanent reproduction thereon. As the image is being fixed on the receiver member, the dielectric support is cleaned of any residual marking particles and recharged for subsequent use.

It is common Practice in the described electrostatographic reproduction devices to use corona charger apparatus to provide an electrostatic field for the electrostatographic process steps requiring such fields. Particularly, such corona charger aPParatus may be used to deposit the uniform charge on the dielectric support, effect transfer of the marking particles of a developed image from the dielectric support to a receiver member, facilitate separation of the receiver member from the dielectric member after the parking particle transfer operation, and neutralize charge on the dielectric support to facilitate cleaning of the support.

Typical corona charger apparatus include a thin wire, fabricated of Tungsten for example, held at a high voltage to generate ions or charge current to charge a surface (dielectric support or receiver member) located closely adjacent to the charger apparatus. If desired, an electrically biased grid may be interposed between the wire and the surface to control the charge deposited on the surface. The corona wire is tightly suspended between two insulating blocks which also provide a support for a connection to a high voltage source. Tension in the corona wire must be accurately set to prevent undesirable sagging of the wire if the tension is insufficient or breakage of the wire if the tension is too high. Since the corona wire is thin, it is fragile and setting of the proper tension is difficult. Further, the corona wire may be partially surrounded by a shield. The shield may be electrically conductive or insulative, and may or may not have an electrical bias applied thereto. For example, the shield can be electrically conductive and held at ground potential in order to increase the charge current. As can be readily appreciated from the foregoing discussion, corona charger apparatus are of a somewhat diverse, comPlex and expensive construction.

While corona charger apparatus are noted for their ability to produce a relatively uniform charge deposit on a surface, the wire oF the charger apparatus deteriorates over time. Such deterioration results in non-uniformity of the charge deposit with a corresponding degradation of the information reproduced by the electrostatographic reproduction device. Accordingly, the corona charger apparatus must be periodically replaced to maintain high quality reproductions. Since as noted above such apparatus are of complex expensive construction, their replacement adds considerable expense to the upkeep and maintenance of electrostatographic reproduction devices. It has therefore been a desirable goal to provide a corona charger apparatus which is of simple, inexpensive construction so that it can be economically discarded when no longer useful for its intended function, and readily replaced by an unskilled operator. A recent corona charger apparatus addressing this desire is found in U.S. Pat. No. 4,754,305 (issued June 28, 1988, in the name of Fantuzzo, et al). The structure of this patent shows a corona charger aPparatus which has a throwaway subassembly. However, a portion of the apparatus remains in the reproduction device. Accordingly, only a partial reduction in complexity and expense of the corona charger apparatus has been achieved by this structure.

SUMMARY OF THE INVENTION

This invention is directed to a universally adaptable corona charger apparatus of simplified construction which is replaceable by an unskilled operator and is inexpensive so that discarding the apparatus when it is no longer useful is cost justified. The corona charger apparatus comprises a conductive corona wite, a generally U-shaped conductive shield, a generally U-shaped non-conductive housing, and a pair of non-conductive end caps. The housing is formed with integral features which retain and accurately space the shield within the housing, locate and properly tension the corona wire, locate and support a grid if required, support electrical terminals for the corona wire and grid, retain and locate the end caps, and enable the assembled apparatus to be accurately located within a reproduction apparatus by an unskilled operator. By use of the integral features, the corona charger apparatus is substantially simplified with a concomitant reduction in its cost. Further, the corona charger apparatus has a universal nature in that it is adapted to be readily configured in a desired manner to carry out a particular desired electrostatographic process step.

The invention, and its objects and advantages, will become more apparent in the detailed description of the preferred embodiment presented below.

BRIEF DESCRIPTION OF THE DRAWINGS

In the detailed description of the preferred embodiment of the invention presented below, reference is made to the accompanying drawings, in which:

FIG. 5 is an end view, in cross-section and on an enlarged scale, of the corona charger apparatus taken along lines 5—5 of FIG. 1;

FIG. 6*a* is a view, in perspective, of the features at one end of the housing of the corona charger for locating one end of the corona wire;

FIG. 6*b* is a view, in perspective, of the features at the opposite end of the housing of the corona charger for locating the opposite end of the corona wire and tensioning the corona wire; and FIG. 7 is an end view, in cross-section and on an enlarged scale, of the housing of the corona charger apparatus taken along lines 7—7 of FIG. 4.

DESCRIPTION OF THE PREFERRED EMBODIMENT

Figure 1:
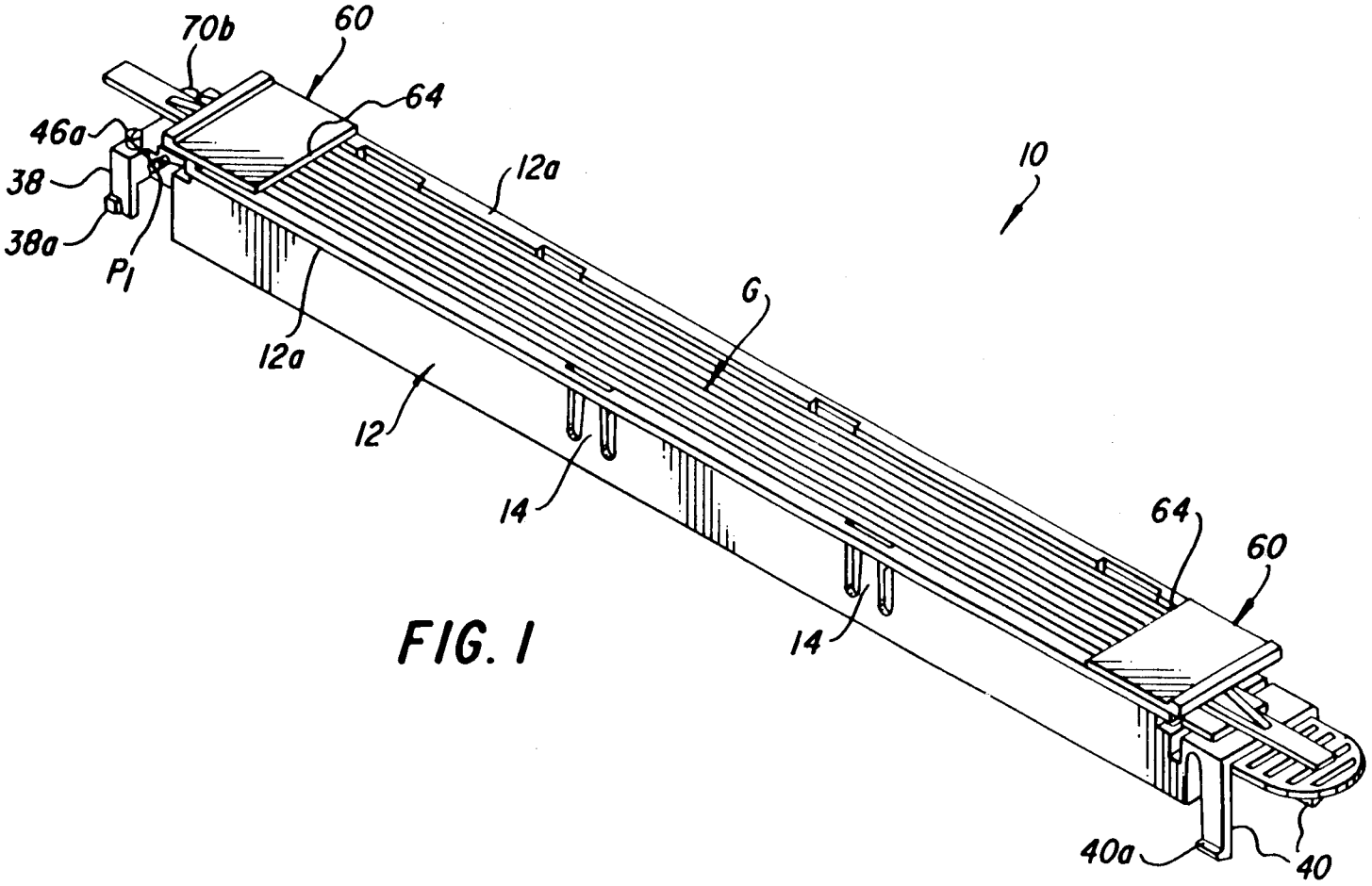
FIG. 1 is a view, in perspective, of the universal corona charger apparatus according to this invention.
Figure 2A:
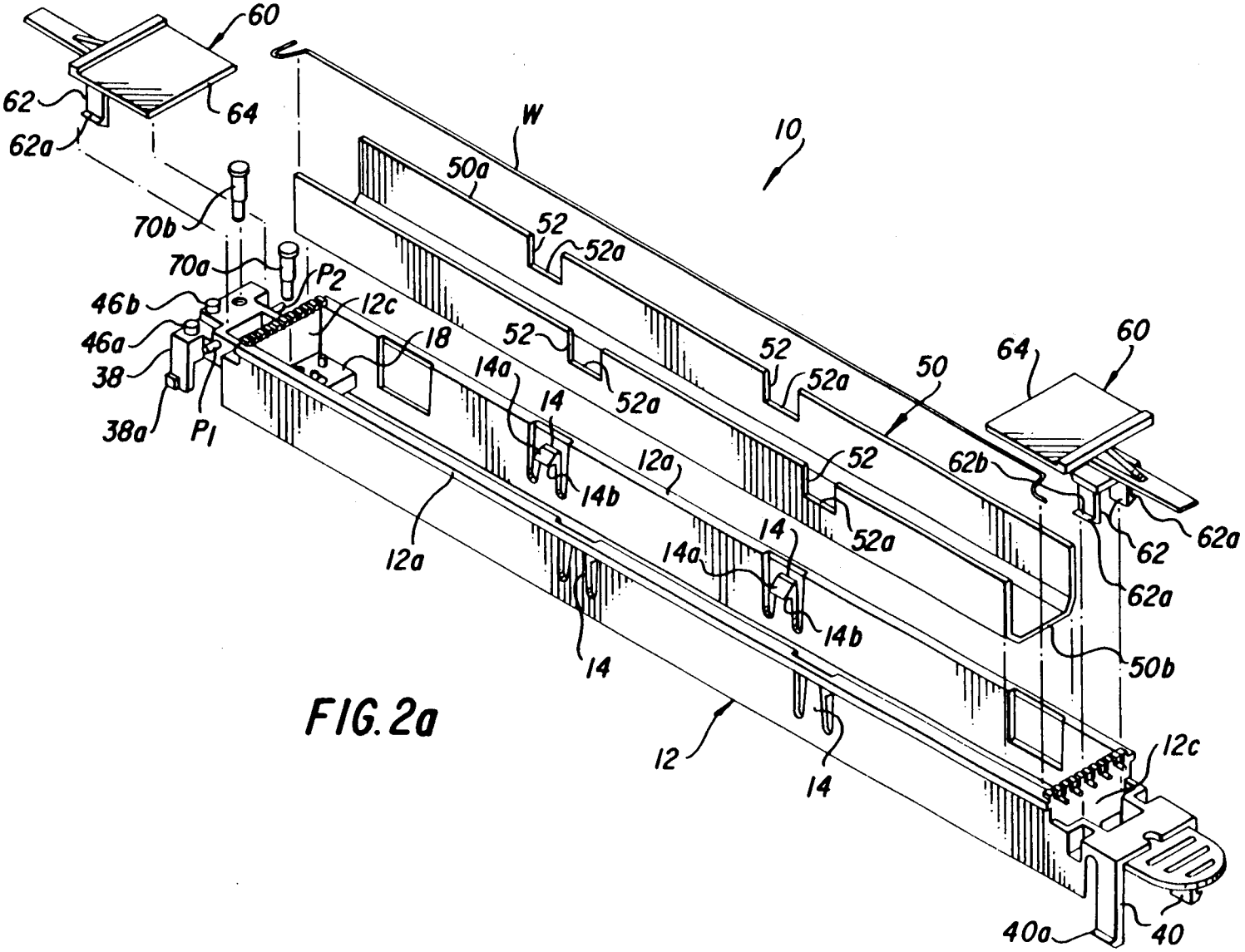
FIGS. 2*a* and 2*b* are exploded views, in perspective, of the corona charger apparatus respectively showing the apparatus in two alternate configurations (i.e., without a grid and with a grid)
Figure 2B:
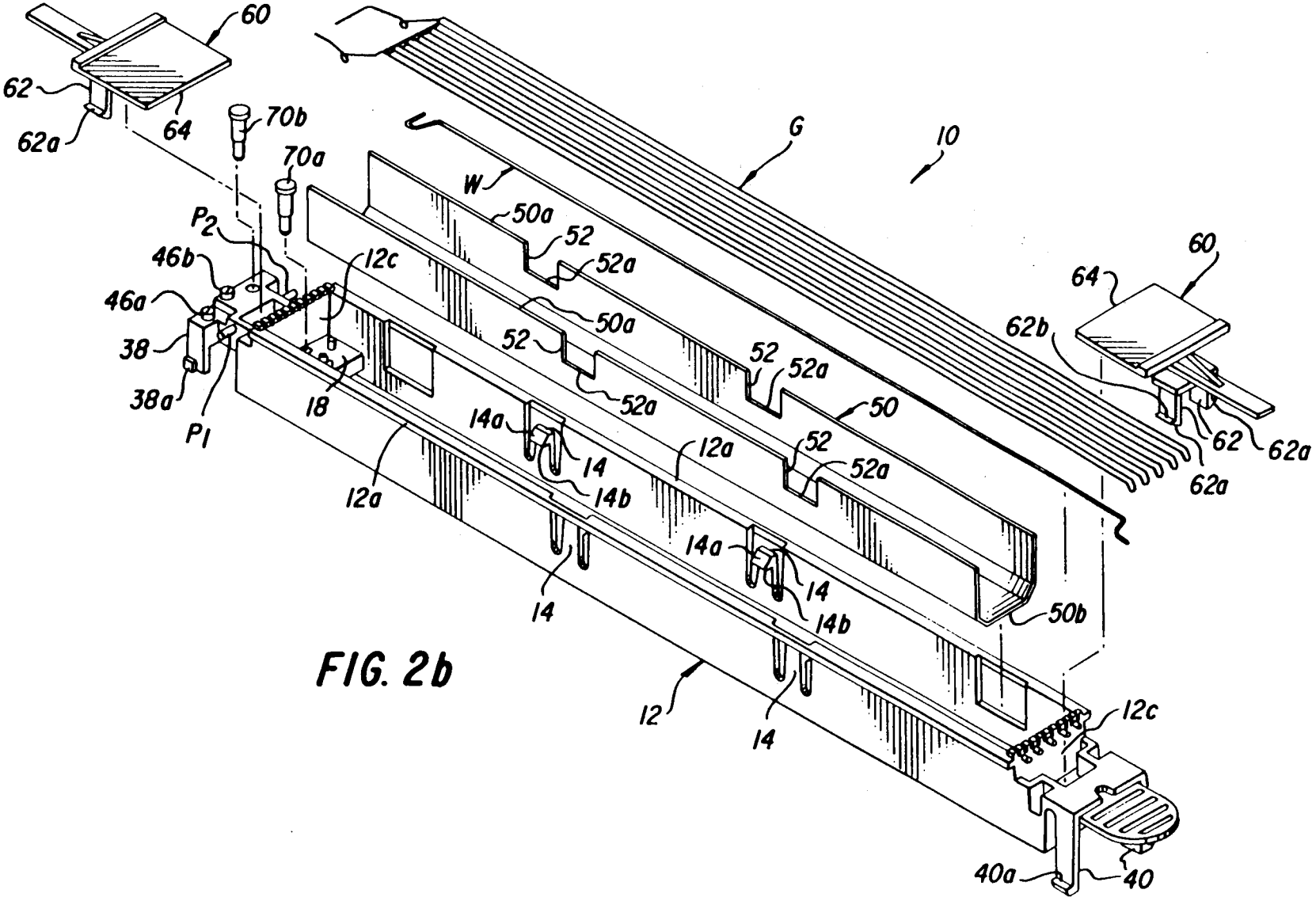

Referring now to the accompanying drawings, FIGS. 1, 2*a*, and 2*b* show the universal corona charger apparatus, designated generally by the numeral 10, according to this invention. The corona charger apparatus 10, in its universal form, includes a housing 12, a shield 50, a corona wire W, end caps 60 and an electrical terminal 70*a*. Of course with certain well known uses for corona chargers, a grid is also required. For such uses, a grid G and its electrical terminal 70*b* can be added to the basic construction for the apparatus 10 without the need for any additional parts.

Figure 3:
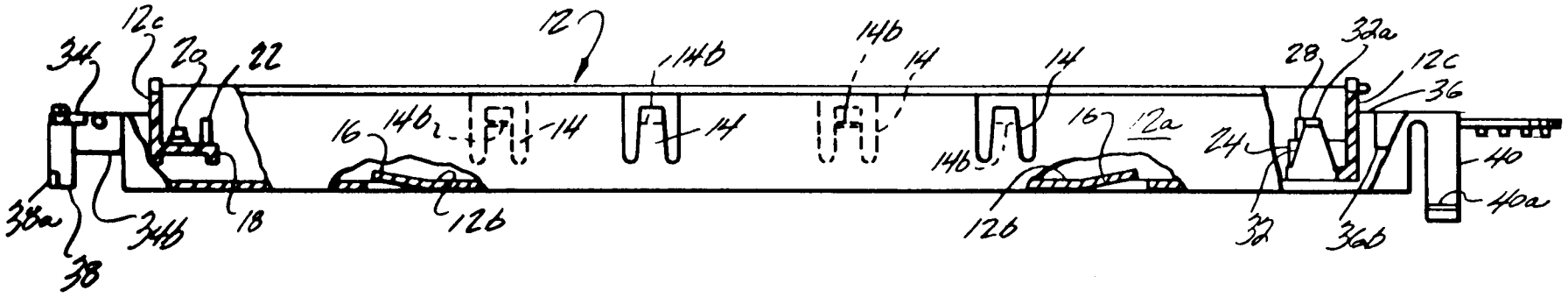
FIG. 3 is a side elevational view of the housing of the corona charger apparatus of FIG. 1 with portions broken away to facilitate viewing.
Figure 4:
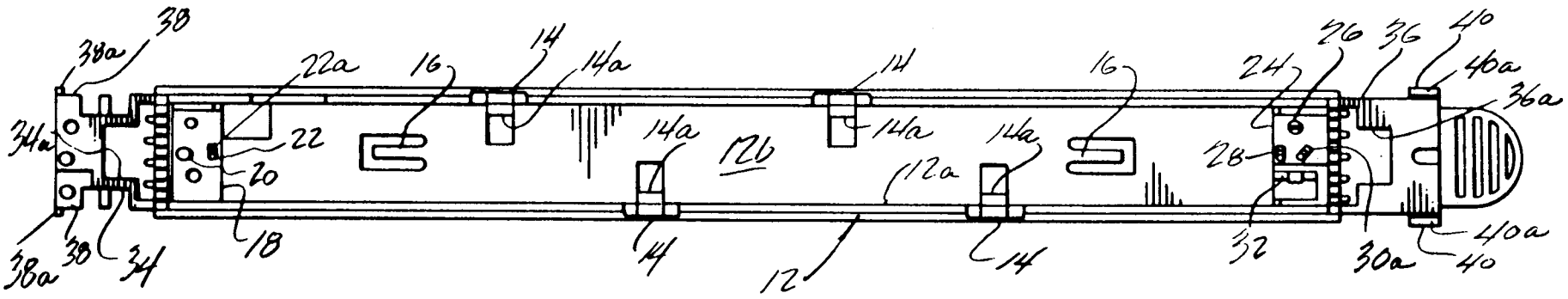
FIG. 4 is a top plan view of the housing for the corona charger apparatus of FIG. 1.

The housing 12 of the corona charger apparatus 10 is fabricated from a non-conductive plastic material such as Noryl SE 1 available from General Electric Co. for example. It is formed, such as by molding for example, with a series of locating and retaining features As best shown in FIGS. 3, 4, and 5, the housing 12 has a first set of features 14 and a second set of features 16 adapted to retain and accurately locate the shield 50 within the housing. The first set of features 14 is configured as a plurality of clips located in the side walls 12*a* of the housing 12. The clips respectively have portions 14*a*, directed into the cavity formed by the housing, with locating shoulders 14*b* directed toward the bottom wall 12*b* of the housing. The second set of features 16 is configured as a plurality of cantilever beams located in the bottom wall 12*b* of the housing 12 extending into the cavity of the housing. The material from which the housing 12 is formed is selected so that the clips and cantilever beams have a substantial degree of resiliency for the purpose to be discussed hereinbelow.

The shield 50 is fabricated from a conductive material such as steel with a zinc chromate finish for example. The shield is of a substantially U-shaped cross-sectional configuration substantially complementary to the cross-sectional configuration of the cavity of the housing 12 (see FIG. 5). The opposed legs 50*a* of the shield 50 have slots 52 adapted to receive the portions 14*a* of the clips of the first set of features 14 of the housing 12. Due to the resiliency of the clips and cantilever beams of the second set of features 16, when the shield 50 is inserted into the cavity of the housing 12, the clips will first be urged out of the way so that the shield can enter the cavity and then be repositioned where the shoulders 14*b* of the clips will be received in the slots 52 of the shield. Meanwhile the cantilever beams engage the bottom wall 50*b* of the shield, and urge the shield in the direction to firmly seat the bases 52*a* of the receiving slots in positive engagement with the respective shoulders 14*a* of the clips. In this manner, the shield 50 is accurately located relative to the housing 12 and securely retained in its position within the cavity of the housing without the use of additional fasteners. It should be noted that the features 14 and the slots 52 of the shield 50 are symmetrical located so that the shield can be readily assembled into the housing 12 irrespective of its orientation along its longitudinal axis.

The corona wire W is a conventional Tungsten corona wire. It is accurately positioned in the housing 12 of the apparatus 10 and retained under proper tension by additional features formed in the housing. Such additional features include crosspieces 18 and 24 formed adjacent opposite ends of the cavity formed by the housing 12, inboard of the end walls 12*c*, between the side walls 12*a*, and substantially parallel to the bottom wall 12*b*. The crosspiece 18 (see FIG. 6*a*) defines a bore into which the electrical terminal 70*a* is seated so as to extend above and below the cross-piece. Of course, an electrical terminal may be provided by a boss formed on cross-piece 18 and plated with a conductive material. Additionally, the cross-piece 18 has a pair of bosses 20, 22 extending upwardly therefrom. The boss 20 has a slot 20*a* adapted to receive the corona wire W, and the boss 22 has a projecting shoulder 22*a* for locating one end of the corona wire, relative to the housing 12, in cooperation with the portion of the boss 22 extending above the shoulder.

The opposite end of the wire W is accurately located relative to the housing 12 by connection to the cross-piece 24. The cross-piece 24 (see FIG. 6*b*) has a plurality of bosses 26, 28, 30 extending upwardly therefrom. The boss 26 has a slot 26*a* adapted to receive the corona wire W, and the boss 28 has a shoulder 28*a* for locating the opposite end of the corona wire, relative to the housing 12, in cooperation with the portion of the boss 28 extending above the shoulder. The boss 30 has a shoulder 30*a* for guiding the wire W from the boss 26, around a tensioning member 32. The tensioning member 32 is a cantilever arm connected to, and extending upwardly from, the bottom of the cross-piece 24. The purpose of the tensioning member 32 is to maintain proper tension in the corona wire W over differing environments and conditions affecting housing dimensions. The arm has a lip 32*a* for capturing the wire W as it passes around the member 32.

On assembly, the wire W is positioned in the slot 26*a* of the boss 26 and staked to the boss by sealing the slot such as by ultrasonic welding for example. The wire is then directed to pass over the shoulder 30*a* of the boss 30, around the tension member 32, and over the shoulder 28*a* of boss 28 toward the opposite end of the housing 12. The wire is then directed to pass over the shoulder 22*a* of the boss 22, around the terminal 70*a*, in electrical contact therewith, and then is positioned in the slot 20*a* of the boss 20. With the wire W under tension, the wire is staked to boss 20 by sealing the slot 20*a*, such as by ultrasonic welding for example. The lower end of the terminal 70*a*, extending beneath the cross-piece 18, is adapted to be coupled to a high voltage source (not shown) thereby enabling a high voltage potential to be applied to the wire W. The location of the corona wire W within the housing 12 is thus accurately defined by the respective shoulders of the bosses 22 and Z8, and the wire is held under constant urging of the member 32 so that proper tension in the wire is maintained.

The end caps 60 are fabricated from a plastic non-conductive material, similar for example to the material of the housing 12. Each of the end caps 60 has a pair of integrally formed clips 62 and a substantially Planar member 64. The clips 62 include a Portion 2*a* with a locating shoulder 62*b*. The housing 12 of the apparatus 10 is formed with locating features 34 and 36 outboard of the end walls 12*c* of the housing adapted to cooperate with the clips 62 to retain the end caps 60 on the housing. The locating features 34 and 36 respectively define openings 34*a*, 36*a*, and locating surfaces 34*b*, 36*b*. The openings are of a dimension selected to be somewhat less than the dimension measured between the tips of portions 62*a* of the respective end cap clips 62. Accordingly when the clips 62 of the end caps are inserted in the openings, due to the resiliency of the clips, the portions 62*a* of the clips will first be urged in a direction to enable the clips to enter the respective openings, and then be repositioned where the shoulders 62*b* of the of the portions 62*a* will engage the locating surfaces 34*b*, 36*b*. In this manner, the end caps 60 will be retained on the housing 12.

Once the end caps are associated with the housing in the described manner, the planar members 64 of the end caps are adapted to serve a multiplicity of functions. When the corona charger apparatus 10 is brought into operative association with a surface to be charged, the planar members 64 are respectively located so as to rest on the tops of the end walls 12*c*. With the thickness of the planar members being of a preselected dimension, proper spacing of the apparatus 10 from the surface is assured. Additionally, the material from which the end caps 60 are formed includes a self-lubricating additive, such as silicon for example. The self-lubricating additive enables the end caps to serve in the capacity as bearings if required when the corona charger apparatus is used in conjunction with an electrostatographic process station where such function is necessary (e.g., for primary charge deposition on a moving dielectric member where the contact of the dielectric member with the end caps controls the desired spacing between the corona charger apparatus and the dielectric member as the dielectric member moves relative to the corona charger). Accordingly, any sliding movement of the apparatus 10 relative to the surface, whether by design or as a result of operation in the device with which the apparatus is associated, is felt at the planar members 64. Since the material of the planar members contains the self-lubricating additive, overall wear of the apparatus 10 due to the sliding movement is substantially prevented. Further, the dimension of the Planar members 64 in the direction overlying the corona wire W is selected to provide a desired window for the effective masking of the charge to be laid down by the apparatus 10.

The housing 12 of the corona charger aPParatus 10 additionally has features 38 and 40 which enable the apparatus to be retained in the device with which the apparatus is to be associated. The features 38 and 40 are integrally formed outboard of the features 34 and 36 respectively. While the features 38 and 40 may be of any suitable design dependent upon the reciprocal parts in the device to which the apparatus 10 is to be associated, they are shown as a set of lugs 38*a* and resilient clips with a locating surfaces 40*a* respectively.

The corona charger apparatus housing 12 is provided with additional features so that the apparatus has the universality to be used in a variety of applications such as an open wire charger (FIG. 2*a*) or a gridded charger (FIG. 2*b*). Such additional features are necessary to enable a functional grid to be assembled, but do not interfere with any other features of the housing 12 when a grid is not required. The additional features include a plurality of parallel slots 42 communicating with the top surfaces of the respective end walls 12*c* of the housing 12, and a series of posts 44 extending outwardly from the end walls between adjacent slots (one end shown in FIG. 7). Further, a pair of slotted bosses 46*a* and 46*b* are located on the top surface of the feature 38; a pair of posts $P_1$, $P_2$ are locate between the feature 38 and the end wall 12*c* extending parallel to the end wall; and a bore 48 is defined through the feature 38.

When it is desired to provide the apparatus 10 with a grid, designated generally by the letter G in FIG. 2*b*, an electrical terminal 70*b* is seated in the bore 48 so as to extend above and below the feature 38. The wire for forming the grid G is a thin stainless steel wire, one end of which is positioned in the slot of the boss 46*a* and staked to such boss by sealing the slot, such as by ultrasonic welding for example. The wire is then looped around one of the posts P and successively strung back and forth through the slots 42 and around the posts 44 across the opening of the housing cavity. The wire is then looped around the other post $P_2$, passed around the terminal 70*b* in electrical contact therewith, and inserted in the slot of the boss 46*b* and staked to such boss by sealing the slot, such as by ultrasonic welding for example. The lower end of the terminal 70*b* extending below the feature 38 is adapted to be coupled to a voltage source (not shown) if required enabling a suitable voltage potential to be applied to the wire of the grid G. Of course, an electrical terminal may be provided by a boss formed on feature 38 and plated with a conductive material It can be appreciated that the simplicity of design for the corona charger apparatus 10 according to this invention renders the apParatus caPable of easy assembly. The component parts (with the exception of the corona wire and grid wire) snap together without fasteners in a manner readily accomplished by hand or in an automated assembly. The features of the housing 12 associated with the corona wire and grid wire make the operation for staking and stringing the wires ideally suited for assembly by robotics.

The invention has been described in detail with particular reference to a preferred embodiment thereof, but it will be understood that variations and modifications can be effected within the spirit and scope of the invention.

We claim:

1. A corona charger apparatus comprising:

a conductive corona wire;

a generally U-shaped conductive shield;

a pair of non-conductive end caps; and a generally U-shaped non-conductive housing, said housing being formed with a plurality of respective integral features which include a plurality of clips respectively having a surface engaging an edge surface of said shield, and at least one cantilever beam spring urging said shield in a direction where said clip surfaces are in held in positive engagement with said edge surfaces of said shield to retain and accurately space said shield within the housing, and further integral features which locate and properly tension said corona wire, support electrical terminals, retain and locate said end caps, and enable the assembled apparatus to be accurately located by an unskilled operator.

2. The invention of claim 1 wherein said clips are formed in the side walls of said housing, and said cantilever beam spring is formed in the bottom wall of said housing.

3. The invention of claim 1 wherein said respective features for locating and tensioning said corona wire include a first cross-piece located adjacent to one end of said housing, and a second cross-piece located adjacent to the opposite end of said housing; said first cross-piece defining an opening for receiving an electrical terminal, and supporting a plurality of bosses respectively capturing one end of said corona wire and locating said corona wire with respect to the walls of said housing; and said second cross-piece supporting a plurality of bosses respectively capturing the opposite end of said corona wire and locating said corona wire with respect to the walls of said housing, and a cantilever spring arm engaging the run of said corona wire between said bosses to apply tension to said corona wire.

4. The invention of claim 3 wherein said end caps respectively include an integrally formed spring clip; and wherein said respective features for retaining and locating said end caps include openings respectively formed in said housing outboard of said crosspieces, with retaining surfaces located adjacent to said openings, said openings adapted to receive said spring clips of said end caPs with said spring clips engaging said retaining surfaces after being received in said openings.

5. The invention of claim 4 wherein said end caps Further respectively include a planar surface member overlying an end portion of said housing when said end caPs are retained by said retaining surfaces to define there between a window through which charge from said corona wire is effective.

6. The invention of claim 5 wherein said planar surface member includes a self-lubricating additive so that said planar surface member is capable of performing a bearing function.

7. The invention of claim 1 wherein said housing further includes integral features which locate and support a grid.

8. The invention of claim 7 wherein said respective features for locating and supporting said grid include end walls adjacent to the ends of said housing, a plurality of slots defined in each of said end walls, and a plurality of posts extending outwardly from each of said end walls respectively located between adjacent slots.

9. The invention of claim 8 wherein said respective features for locating and supporting said grid further includes means, outboard of one end wall, for defining an opening receiving an electrical terminal, said means supporting a pair of bosses respectively capturing opposite ends of said grid.

* * * * *